US005622505A

United States Patent [19]

Hashiguchi et al.

[11] Patent Number: 5,622,505

[45] Date of Patent: Apr. 22, 1997

[54] MULTI-ROW CONNECTOR COMPRISING FLEXIBLE CONTACT SHEETS WITH INSULATING RESILIENT PIECES

[75] Inventors: Osamu Hashiguchi; Kazuomi Sato; Yoshiaki Ichimura, all of Tokyo, Japan

[73] Assignee: Japan Aviation Electronics Industry, Limited, Japan

[21] Appl. No.: 546,585

[22] Filed: Oct. 23, 1995

[30] Foreign Application Priority Data

Oct. 21, 1994 [JP] Japan ..... 6-256598

[51] Int. Cl.[6] ..... H01R 9/09

[52] U.S. Cl. ..... 439/67; 439/260

[58] Field of Search ..... 439/67, 495, 260, 439/493, 77, 629, 499, 626, 637, 638

[56] References Cited

U.S. PATENT DOCUMENTS

| | | | |
|---|---|---|---|
| 4,911,643 | 3/1990 | Perry et al. | 439/67 OR |
| 5,044,980 | 9/1991 | Krumme et al. | 439/67 X |
| 5,316,486 | 5/1994 | Tanaka et al. | 439/67 X |
| 5,505,625 | 4/1996 | Byer et al. | 439/67 X |

*Primary Examiner*—P. Austin Bradley
*Assistant Examiner*—Daniel Wittels
*Attorney, Agent, or Firm*—Laff, Whitesel, Conte & Saret, Ltd.

[57] ABSTRACT

For electrically connecting a conductor pattern (25) printed on a surface of a flexible insulator sheet (23) to a circuit board (13), an insulating resilient piece (33) is attached to the opposite surface of the flexible sheet and obliquely projects from said opposite surface. A connecting member (15) having a contact (17) to be electrically connected to the circuit board has an insulator block (16) having a receiving hole (18) for receiving the flexible sheet and the resilient piece together. The contact is exposed in the receiving hole so that the contact is brought into contact with the conductor pattern of the flexible sheet when a projecting portion of the resilient piece is pressed towards the flexible sheet received in the receiving hole by an actuating member (31, 39, 41). By the use of the connecting arrangement, a multi-row connector (11) is assembled which is for establishing electric connection to the connecting member as a paired connector. The multi-row connector comprises a first insulator block (19) for receiving the flexible sheets as flexible contact sheets in sheet receiving holes (21) and a second insulator block (27) having a sheet receiving groove (29). The insulating resilient pieces are fixed to bottom sheet ends of the flexible contact sheets. After inserted between free ends of the resilient pieces, the actuating member is turned around its axis to establish the electric connection.

11 Claims, 9 Drawing Sheets

MULTI-ROW CONNECTOR COMPRISING FLEXIBLE CONTACT SHEETS WITH INSULATING RESILIENT PIECES

BACKGROUND OF THE INVENTION

This invention relates to an electrical connector for electrically connecting a flexible printed circuit board to a connecting object, such as an FPC (flexible printed circuit) connector, which is of a ZIF (zero insertion force) type and is for connection with a minimal operating force.

Japanese patent publication (B2) No. 11,105 of (1982) discloses a connector for electrically connecting a flexible printed circuit board to another printed circuit. The flexible printed circuit board comprises a flexible insulator sheet with front and rear surfaces and a sheet end and a conductor pattern extending on said front surface to said sheet end. A rigid insulator plate is bonded onto the rear surface of the flexible printed circuit for reinforcing the flexible board. A connector member is mounted on the circuit board. The connector member has an elastic contact having a terminal portion which is electrically connected to the circuit board. The connecting member has an connector insulator having a contact hole in which the elastic contact is supported to elastically project a contact portion thereof. In order to establish connection of the conductor pattern with the contact, the flexible printed circuit board is inserted together with the rigid insulator plate into the contact hole against a pressing force due to the elasticity of the elastic contact. Therefore, the connector is not a ZIF type. The conductor pattern is disadvantageously damaged by friction with the contact during connecting operation. Accordingly, the flexible printed circuit results in a decreased life time.

There are known in the prior art various multi-row connectors using the flexible printed circuit boards having a plurality of conductor patterns as contact sheets. Examples are disclosed in U.S. Pat. No. 4,881,908, in U.S. Pat. No. 4,892,487, and in U.S. Pat. No. 5,102,342.

It is possible in these prior documents to understand that the paired connector comprises contact rows of a plurality of contacts in each contact row. The multi-row connector comprises a first insulator block having a sheet receiving hole. A pair of flexible contact sheets has individual front surfaces and individual sheet ends. On each front surface, rows of parallel conductor patterns are arranged to reach the sheet ends and are not less in number than the contacts in each contact row of a paired or mating connector. The flexible contact sheets are received in the sheet receiving hole in a back to back opposing relation. A second insulator block has a sheet receiving groove for receiving the flexible contact sheets with the sheet ends protruded through the sheet receiving groove. An actuating member is for actuating the flexible contact sheets to bring the parallel conductor patterns near to the contacts of the paired connector after the second insulator block is brought into contact with the paired connector to place the parallel patterns near to the contacts at the sheet ends.

It is additionally possible to understand that the multi-row connector is further for connection to a daughter board having a pair of board surfaces and a shim end having a predetermined thickness between the board surfaces. A plurality of conductive patterns are formed on the board surfaces in correspondence to the conductor patterns of the flexible contact sheets.

In such a conventional multi-row connector, it takes too much labour or many operations to bring the connector into mechanical contact with the paired connector with the conductor patterns brought into electric contact with the contacts of the paired connector. Besides, it is hardly possible to use a plurality of FPCs in the conventional multi-row connector with a high contact density.

SUMMARY OF THE INVENTION

It is a principal object of this invention to provide an electrical connector of a ZIF type for electrically connecting a flexible printed circuit board to a connecting object to insuring a long life time of the flexible printed circuit board.

It is another principal object of this invention to provide a multi-row connector which can be connected to a paired connector without many operations.

It is another object of this invention to provide a small multi-row connector with a plurality of FPCs used and with a high contact density achieved.

It is a subordinate object of this invention to provide a multi-row connector which is of the type described and which is for used in establishing electric connection between a daughter board and the paired connector used as a mother board.

Other objects of this invention will become clear as the description proceeds.

According to the present invention, there is provided an electrical connector for electrically connecting a flexible printed circuit board to a connecting object, the flexible printed circuit board comprising a flexible insulator sheet with front and rear surfaces and a sheet end and a conductor pattern extending on the front surface to the sheet end. The electrical connector comprises: an insulating resilient piece having an end portion and an extension portion extending from the end portion in a different direction from the end portion, the insulating resilient piece being attached to the rear surface of the flexible printed circuit board so that the end portion is arranged to the sheet end of the flexible printed circuit board and the extension portion extending away from the rear surface of the flexible printed circuit board; a connecting member for being electrically and mechanically connected to the connecting object, the connecting object comprising an insulator block and a contact supported in the insulator block, the contact having a terminal end connected to the connecting object and a contact portion, the connecting member having a receiving hole for loosely receiving the end portion of the insulating resilient piece and the sheet end of the flexible printed circuit board together, the contact portion exposed in the receiving hole; and an actuating member for pressing the extension portion of the insulating resilient piece towards the rear surface of the flexible printed circuit board when the end portion of the insulating resilient piece and the sheet end of the flexible printed circuit board are received together in the receiving hole, whereby the conductor pattern of the flexible printed circuit board is pressed onto and is brought into contact with the contact portion.

According to this invention, there is further provided a multi-row connector for establishing electric connection to a paired connector comprising contact rows of a plurality of contacts in each contact row, the multi-row connector comprising: a first insulator block having a sheet receiving hole; a pair of flexible contact sheets having individual front surface and individual sheet ends with rows of parallel conductor patterns, not less in number than the contacts in each contact row, arranged on each of the front surfaces to reach the sheet ends and with the flexible contact sheets received in the sheet receiving hole in a back to back opposing relation; a second insulator block having a sheet receiving groove for receiving the flexible contact sheets with the sheet ends protruded through the contact receiving groove; and an actuating member for actuating the flexible contact sheets to bring the parallel conductor patterns at the sheet ends near to the contacts after the second insulator block is brought into contact with the paired connector to place the parallel patterns near at the sheet ends to the contacts. The multi-row connector comprises: a pair of insulating resilient pieces having individual piece ends fixed to the sheet ends, respectively, and extended backwardly of the flexible contact sheet to have individual free ends spaced apart by a predetermined distance and to be placed in the sheet receiving groove; the actuating member having a first and a second diameter smaller than and greater than the predetermined distance, respectively, so as to be freely inserted between the free ends and to push the free ends apart when the actuating member is inserted between the free ends to be subsequently positioned between the free ends with the first and the second diameters directed substantially perpendicularly and parallel to the predetermined distance, respectively.

DESCRIPTION OF THE PREFERRED EMBODIMENTS

Figure 1:
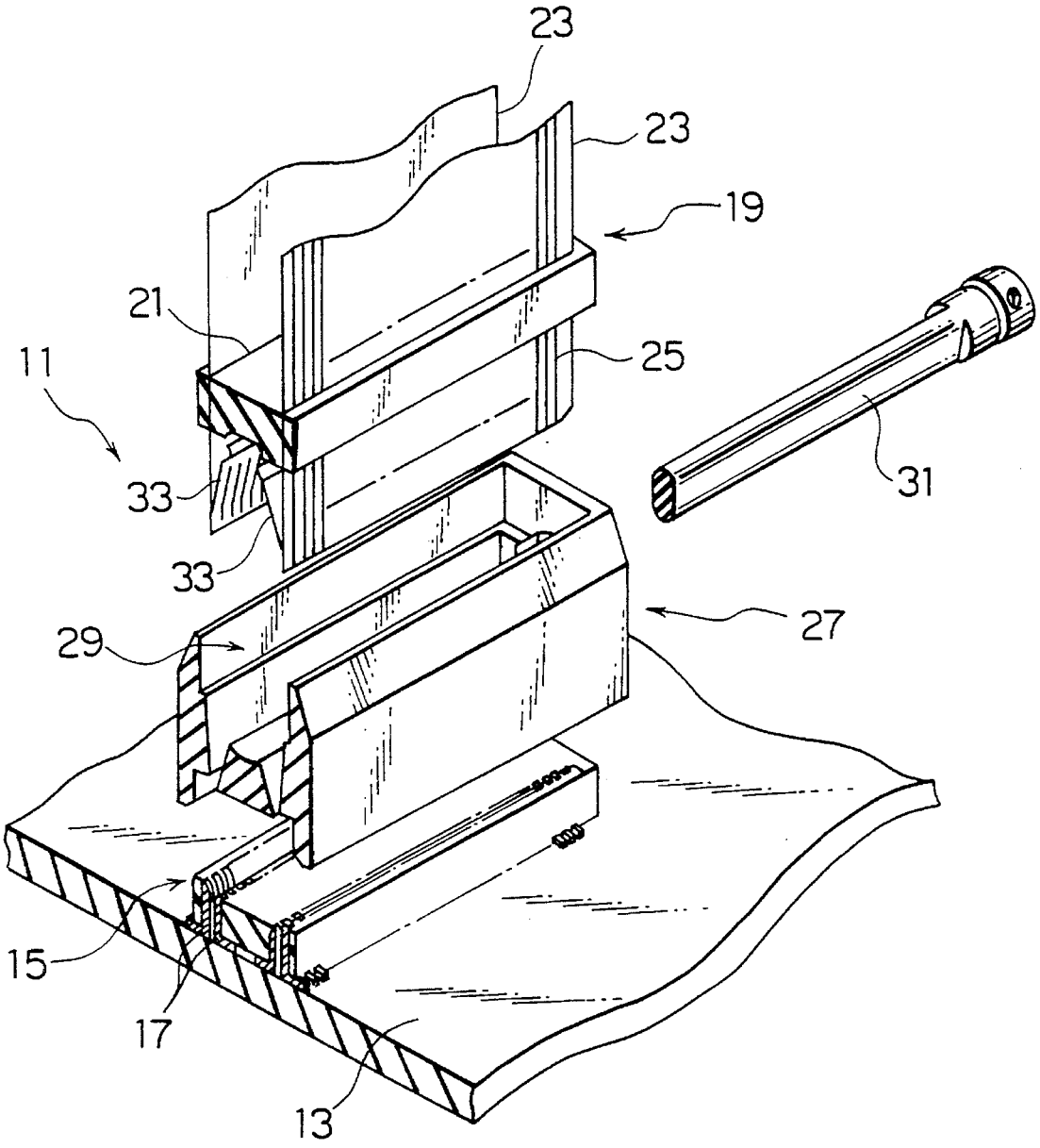
FIG. 1 is a partial perspective exploded view of a multi-row connector according to a first embodiment of this invention.
Figure 2:
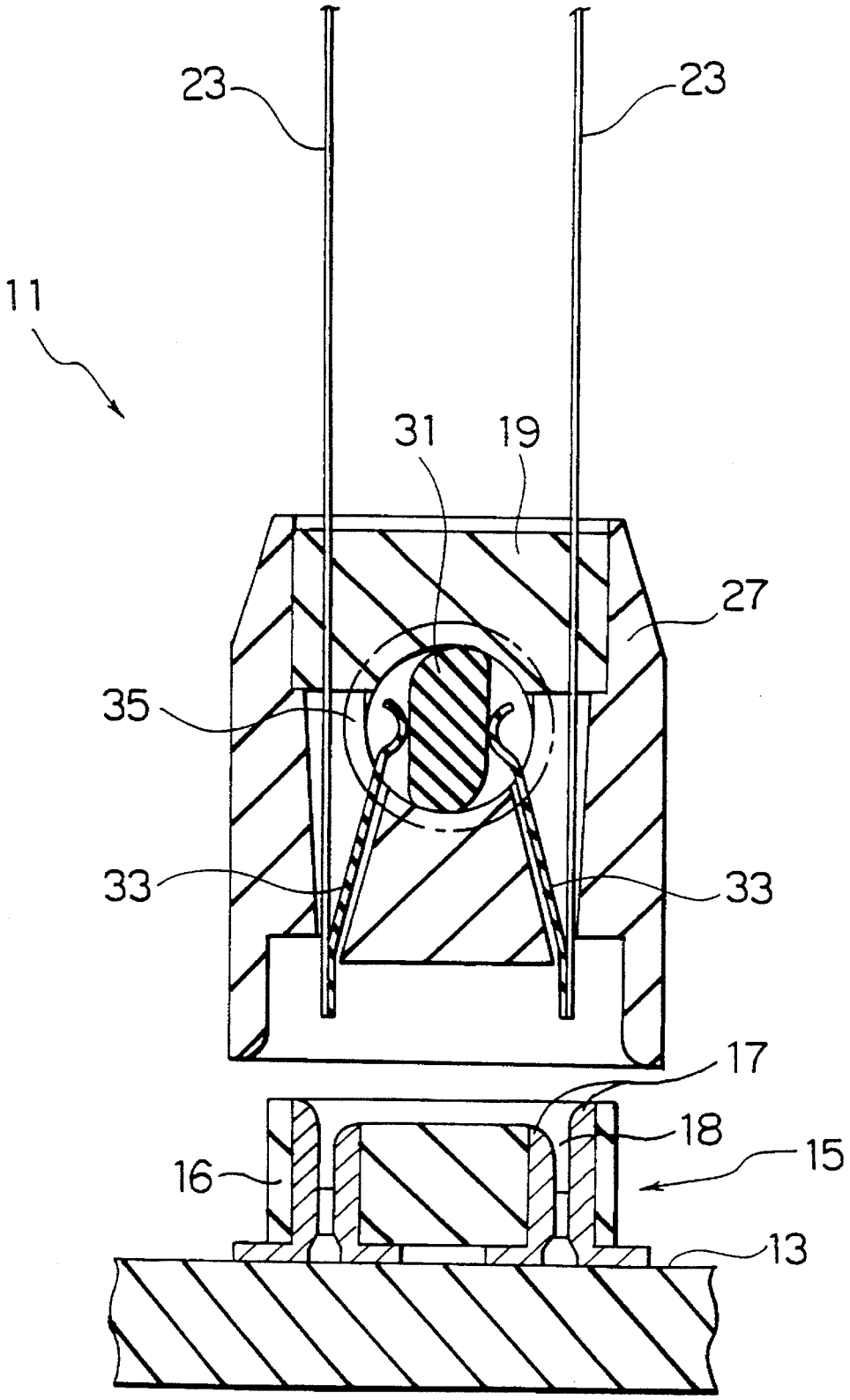
FIG. 2 is a vertical sectional view of the multi-row connector illustrated in FIG. 1.
Figure 3:
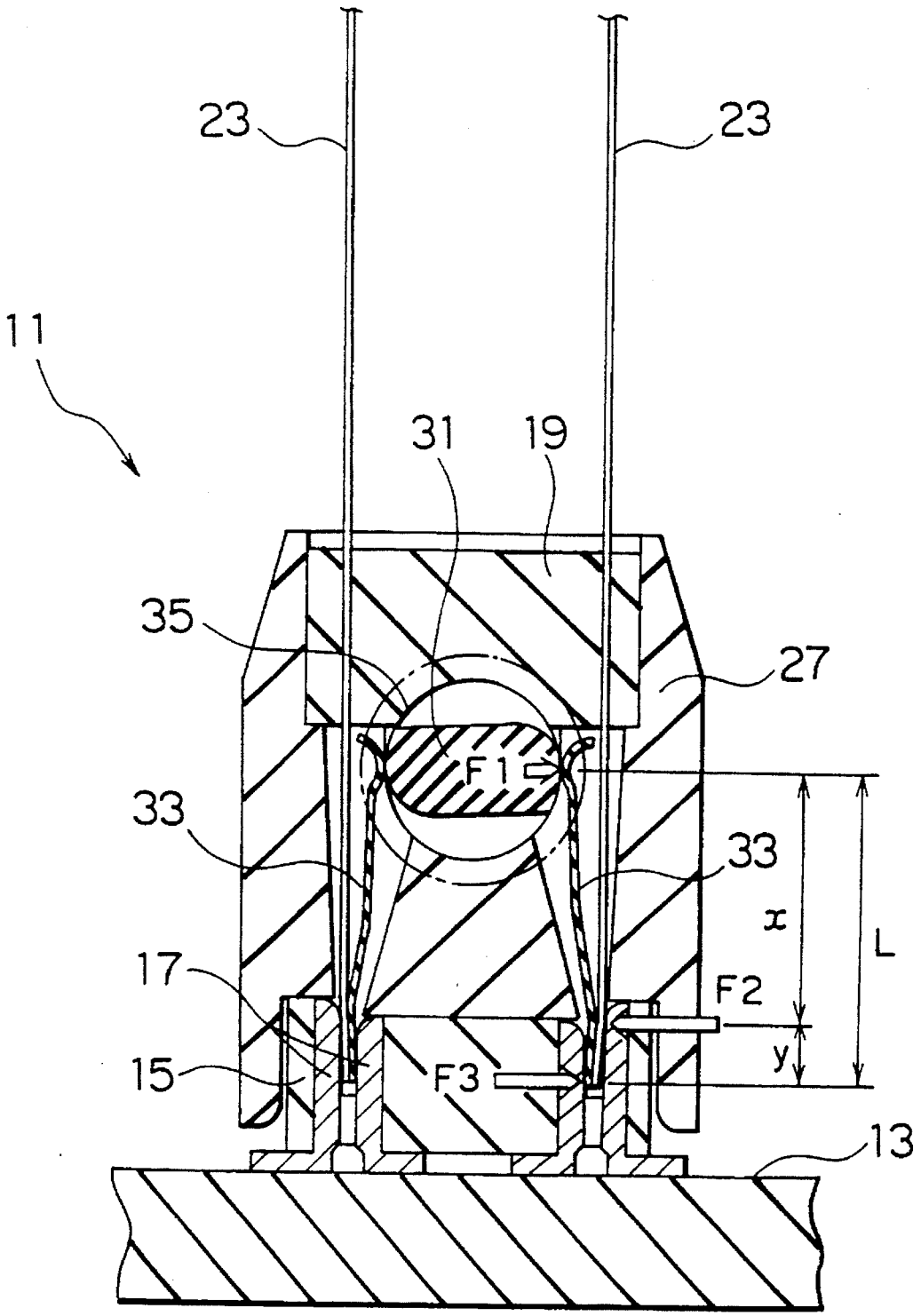
FIG. 3 is another vertical sectional view of the multi-row connector illustrated in FIGS. 1 and 2.

Referring now to FIGS. 1 through 3, exemplarily only depicted is a multi-connector 11 using, as a plurality of flexible contact sheets, a plurality of flexible printed circuit boards having a plurality of conductive patterns according to a first embodiment of this invention. The multi-row connector 11 is for establishing electric connection to a printed circuit board 13 or a paired or mating connector 15 used as a mother board. The paired connector 15 comprises an insulator block 16 and contact rows of a plurality of contacts 17 supported in the insulator block 16. Each of the contacts 17 has a contact portion and a terminal end connected to the circuit board as shown in FIGS. 2 and 3.

The multi-row connector 11 comprises a first insulator block 19 having two sheet receiving slits 21 collectively as a sheet receiving hole. In the multi-row connector 11, a pair of insulating flexible contact sheets 23 has individual front surface depicted in FIG. 1, one as seen and the other opposite to a direction of sight, and individual sheet ends depicted at bottom of the flexible contact sheets 23. It is possible as will be understood from the following to use a single flat flexible sheet as the flexible contact sheet 23. Rows of parallel conductor patterns 25 are arranged to reach the sheet ends on each of the front surfaces. The conductor patterns 25 are not less in number on each front surface than the contacts 17 in each contact row so that the contacts 17 of the contact rows may be brought into electric contact with the conductor patterns 25. The flexible contact sheets 23 are put in the sheet receiving hole 21 in a back to back opposing relation, as is clear in FIG. 1, with the sheet ends brought onto a common plane.

In the multi-row connector 11, a second insulator block 27 has a sheet receiving groove 29 for receiving the flexible contact sheets 23 with the sheet ends protruded through the contact receiving groove 29. More specifically, the contact receiving groove 29 has a bottom end which is in contact in FIG. 3 with the paired connector 15. An actuating member 31 is for actuating the flexible contact sheets 23 to bring the parallel conductor patterns 25 at the sheet ends near to the contacts 17 after the second insulator block 27 is brought into contact with the paired connector 15 to place the conductor patterns 25 near at the sheet ends to the contacts 17.

According to a salient feature of this invention, the multi-row connector 11 comprises a pair of insulating resilient pieces 33 having individual piece ends fixed to the sheet ends of the flexible contact sheet 23, respectively, and extended backwardly of the flexible contact sheet 23 to have individual free ends or extension portions extending away from the rear surfaces to be spaced apart by a predetermined distance and to be placed in the sheet receiving groove 29. The actuating member 31 has a first and a second diameter smaller and greater than the predetermined distance so as to be freely inserted between the free ends and to push the free ends apart when the actuating member 31 is inserted between the free ends to be subsequently positioned between the free ends with the first and the second diameters directed substantially perpendicular and parallel to the predetermined distance.

As best depicted in FIGS. 2 and 3, the first and the second insulator blocks 19 and 27 have side surfaces parallel to a direction of the opposing relation of the flexible contact sheets 23, namely, to a sheet of FIG. 2 or 3. The first and the second insulator blocks 19 and 27 have a member receiving hole 35 larger than a greater one of the first and the second diameters. After the first and the second insulator blocks 19 and 27 are put together, the actuating member 31 is inserted through the member receiving hole 35 between the free ends of the insulating resilient pieces 33 with the first and the second diameters directed appropriately perpendicular and parallel (FIG. 2) to the predetermined distance. Later, the actuating member 31 is turned so that the first and the second diameters are directed substantially perpendicular and parallel (FIG. 3) to the predetermined distance. In this manner, the actuating member 31 serves as an operating cam for insertion through the member receiving hole 35.

The paired connector 15 further has a receiving holes 18 for loosely receiving the sheet end of the flexible contact sheets 23 and the end portions of the insulating resilient pieces 33 together, the contact portions of the contacts 17 are exposed in the receiving holes 18. In the shown embodiment, each of contacts 17 is provided with each of the receiving holes 18.

In FIG. 3, where the actuating member 31 is placed as the actuating cam between the free ends of the insulating resilient pieces 33 with the second or greater diameter directed parallel to the predetermined distance, three forces F1, F2, and F3 for the insulating resilient pieces 33 having a longitudinal length L are related to one another in accordance with the following equations.

$$F1 \times L = F2 \times y$$

and $$F1 \times x = F3 \times y$$

where $$L = x + y$$

Therefore, $$F1 = F2 \times y / L$$

and $$F1 = F3 \times y / x.$$

As a result, the force F1 becomes a minimal operating force by the use of the operating cam.

Figure 4:
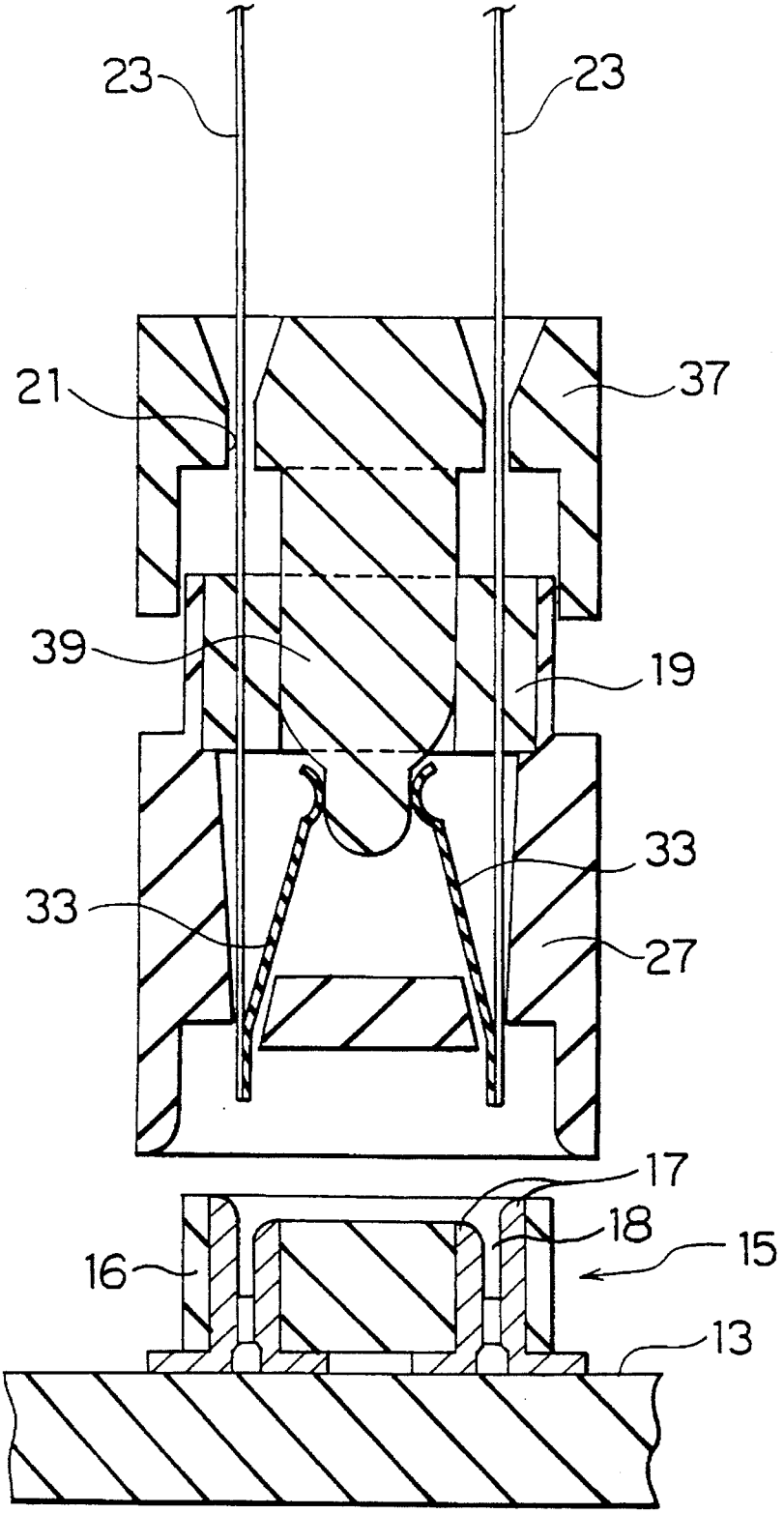
FIG. 4 is a vertical sectional view of a modification of the multi-row connector illustrated in FIGS. 1 through 3.
Figure 5:
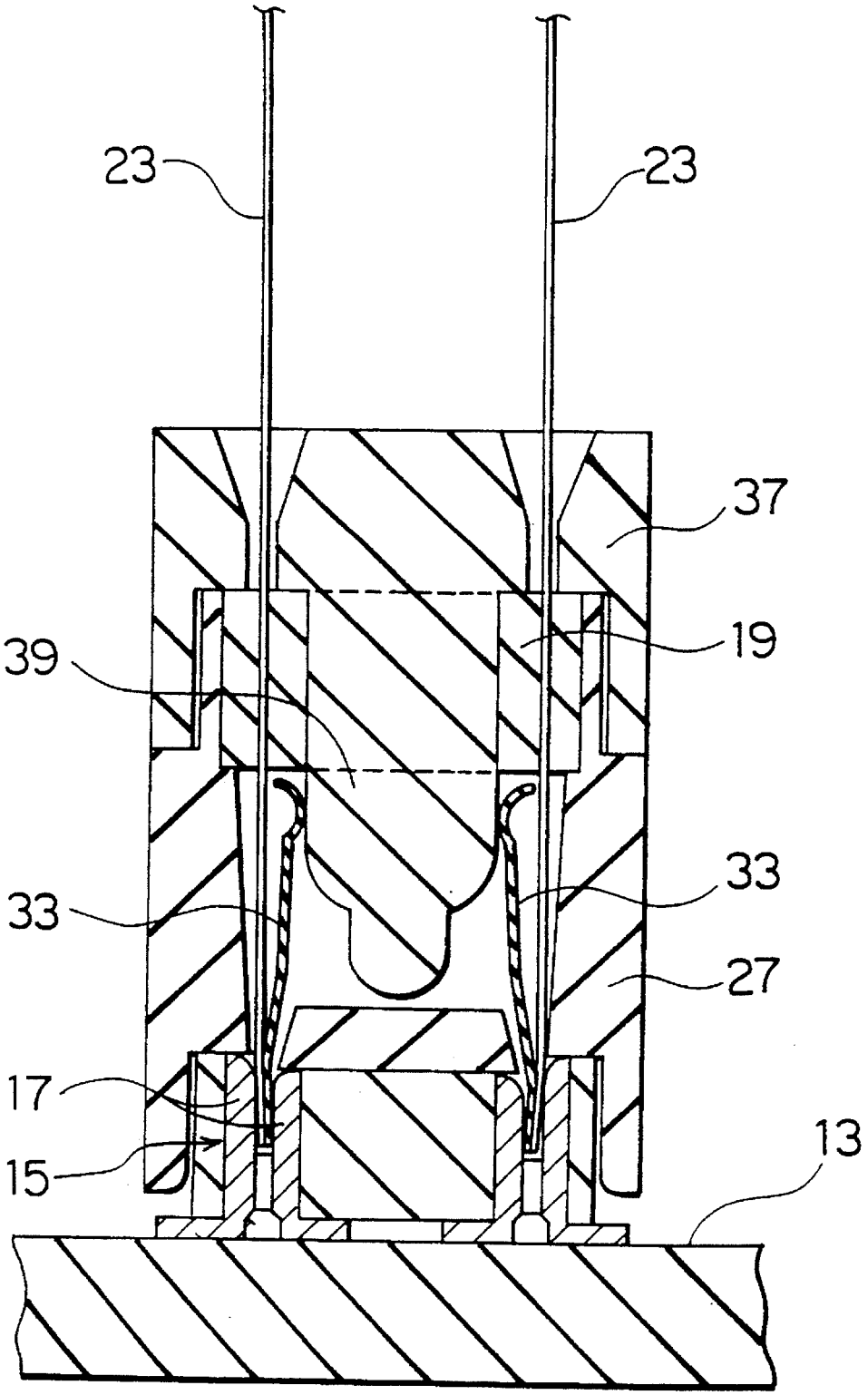
FIG. 5 is another vertical sectional view of the modification illustrated in FIG. 4.
Figure 6:
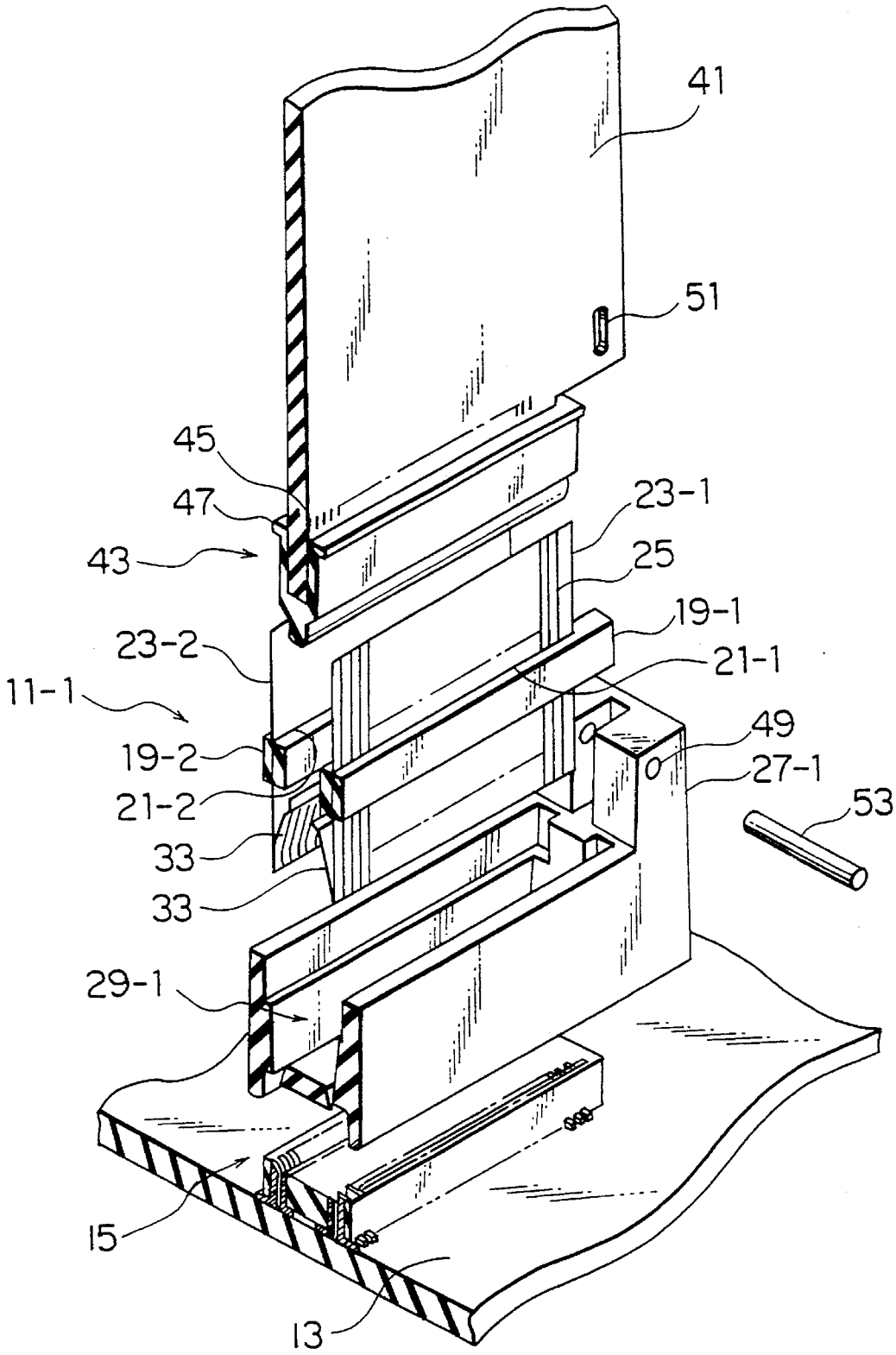
FIG. 6 is a partial perspective exploded view of a multi-row connector according to a second embodiment of this invention.
Figure 7:
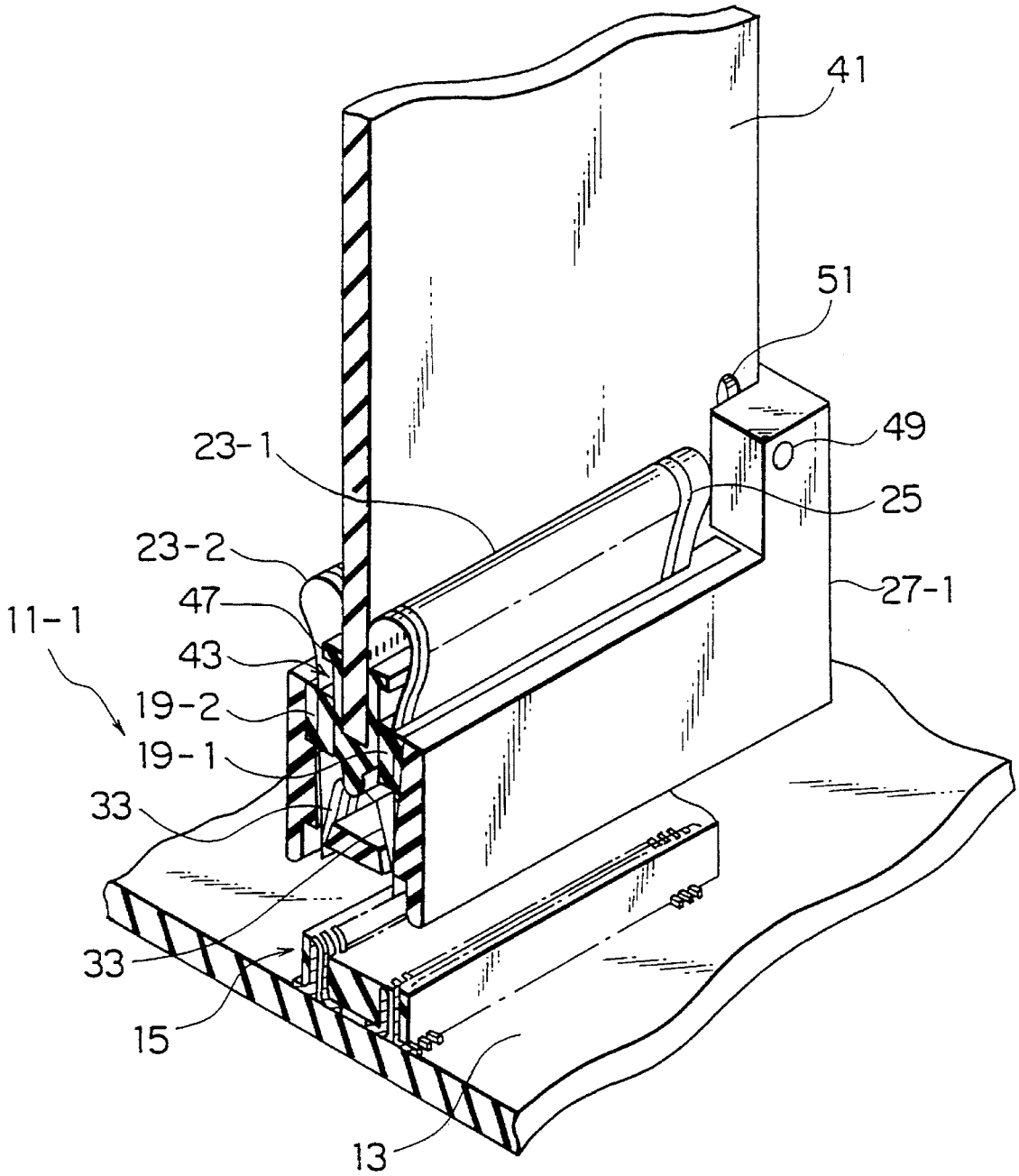
FIG. 7 is a partial perspective view of the multi-row connector depicted in FIG. 6.
Figure 8:
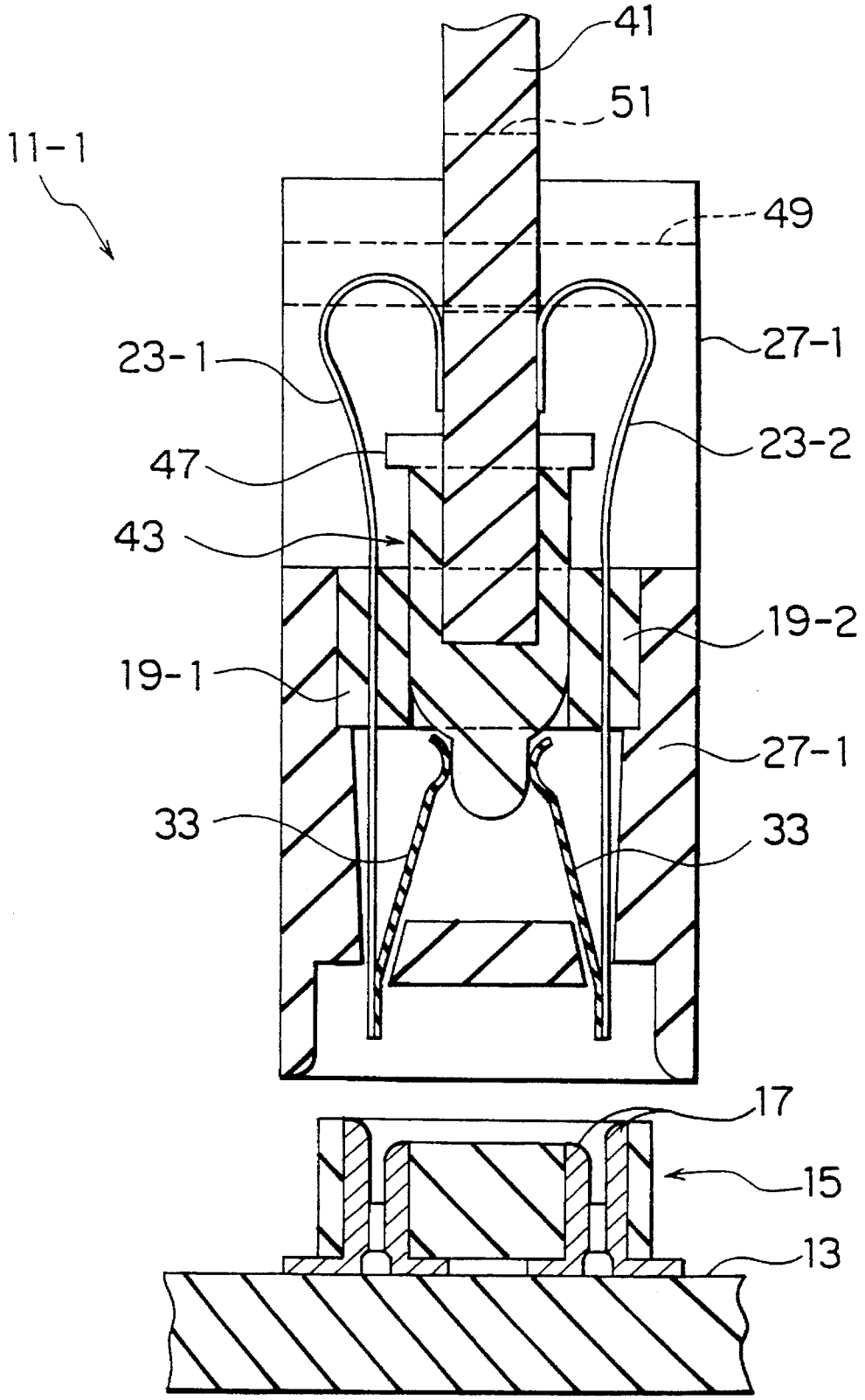
FIG. 8 is a vertical sectional view of the multi-row connector illustrated in FIGS. 6 and 7.

Referring afresh to FIGS. 4 and 5, the description will proceed to a modification of the multi-row connector depicted in FIGS. 1 through 3.

The multi-row connector 11 further comprise a cover member 37 for covering and receiving the first insulator block 19 on its top. The cover member 37 has an insertion portion 39 protruding in the sheet receiving hole 21 to serve as the actuating member 31 when inserted between the free ends. The actuating member 31 of FIGS. 1 through 3 is no more separately necessary.

Referring now to FIGS. 6 through 9 with FIGS. 1 through 3 again referred to, attention will be directed to a multi-row connector 11-1 according to a second embodiment of this invention. Similar parts are designated by like reference numerals.

This multi-row connector 11-1 is for further connection to a daughter board 41 having a pair of board surfaces of a predetermined thickness between the board surfaces. The daughter board 41 has a shim end 43 of the predetermined thickness downwardly in FIGS. 6 through 9. The predetermined thickness is not smaller than the predetermined distance. A plurality of conductive patterns 45 are formed on the board surfaces in correspondence to the conductor patterns 25. It is unnecessary that the conductive patterns 45 should reach a bottom end of the shim end 43.

The first insulator block is divided into first primary and secondary insulator blocks 19-1 and 19-2 having a pair of sheet receiving holes 21-1 and 21-2 collectively as the sheet receiving hole mentioned in connection with FIGS. 1 through 3 for individually receiving the flexible contact sheets 23. The shim end 43 serves as the actuating member 31. The flexible contact sheets are now two separate flexible contact sheets 23-1 and 23-2 having tip ends, respectively. When pushed between the flexible contact sheets 23-1 and 23-2 downwardly of FIGS. 6 through 9, the daughter board 41 tucks the flexible contact sheets 23-1 and 23-2 with the conductor patterns 25 brought into contact with the conductive patterns 45 since the flexible contact sheets 23-1 and 23-2 are easily bent to the the board surfaces.

Figure 9:
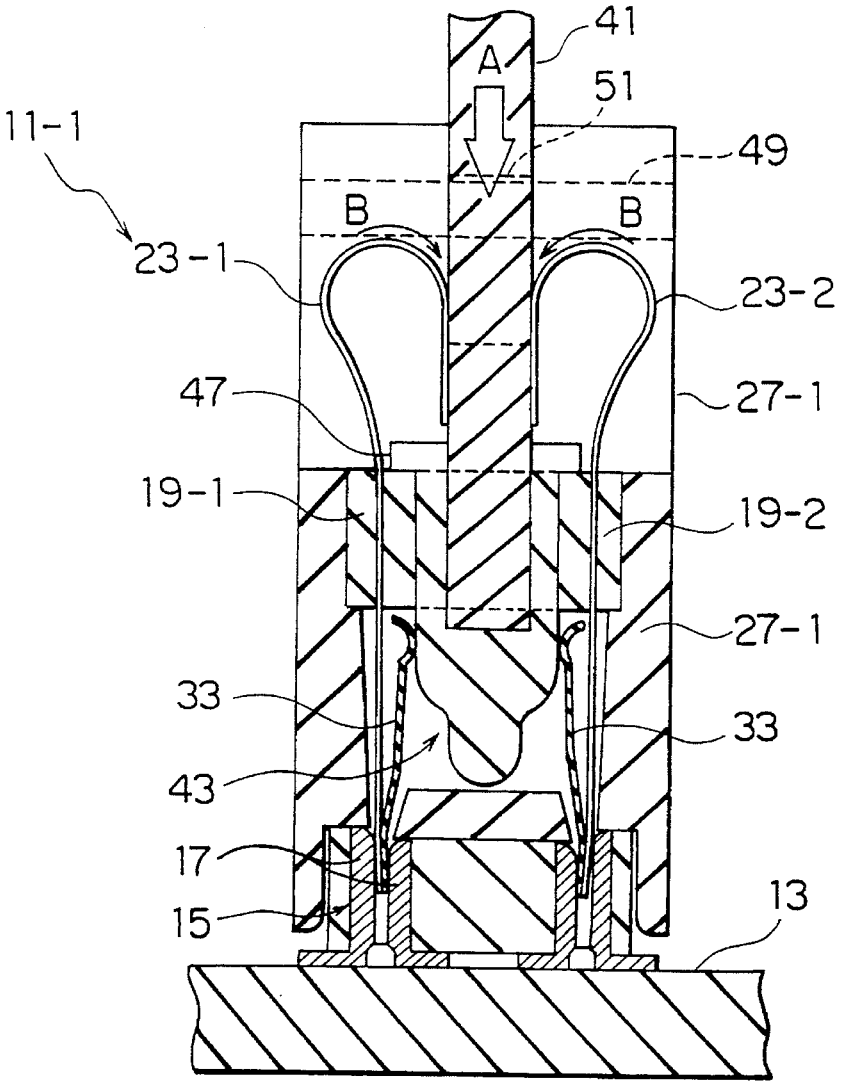
FIG. 9 is another vertical sectional view of the multi-row connector illustrated in FIGS. 6 and 7.

The shim end 43 comprises an engaging edge portion having flanges 47 forwardly and backwardly protruded from the board surfaces, respectively, for engaging with the first insulator block 19 as best shown in FIG. 9. The first insulator block 19 has a shim end receiving opening between the first primary and the secondary insulator blocks 19-1 and 19-2. When the shim end 43 is put between the free ends, the flanges 47 abut the first insulator block 19.

The second insulator block 27-1 has a pinhead receiving holes 49. The daughter board 41 has a pinbody receiving hole 51 for alignment with the pinhead receiving hole 49. An insertion pin 53 is inserted in the pinhead and the pinbody receiving holes 49 and 51 after the shim end 43 is put in the shim end receiving opening to bring the pinhead and the pinbody receiving holes 49 and 51 in alignment. The pin 53 is for preventing the first insulator block 19 from being inadvertently separated from the second insulator block 27.

Figure 10:
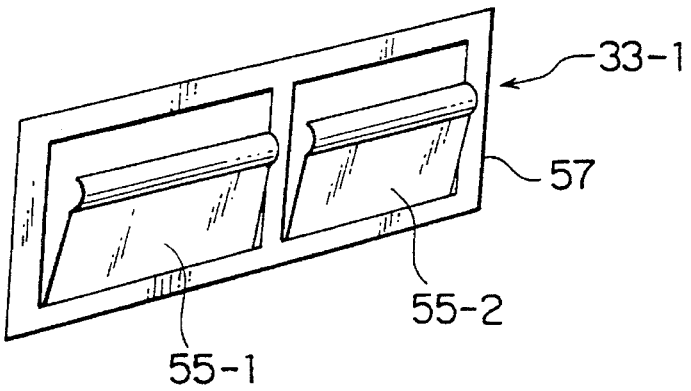
FIG. 10 is a perspective view of resilient pieces for use with a modification in the multi-row connector depicted in any one of FIGS. 1, 4, and 6.

Referring to FIG. 10, an insulating resilient piece 33-1 may be divided into left and right resilient pieces 55-1 and 55-2 and a framework 57 if the free ends of the flexible contact sheets 23-1 and 23-2 are not stable in the sheet receiving groove 29 or 29-1. The resilient pieces 55-1 and 55-2 are enclosed by the framework 57. Use of the frame work 57 increases mechanical strength of the insulating resilient pieces 33 described in conjunction with FIGS. 1 through 3.

In the embodiment, this invention is described as regards a multi-row connector. However, it will be understood by those skilled in the art that the present invention can be applied for establishing an electrical connection between a flexible printed circuit board having a single or a plurality of conductor patterns and a connecting object such as a printed circuit board.

What is claimed is:

1. An electrical connector for electrically connecting a flexible printed circuit board to a connecting object, said flexible printed circuit board comprising a flexible insulator sheet with front and rear surfaces and a sheet end and a conductor pattern extending on said front surface to said sheet end, which comprises:

an insulating resilient piece having an end portion and an extension portion extending in a different direction from said end portion, said insulating resilient piece being attached to the rear surface of said flexible printed circuit board so that said end portion is arranged to the sheet end of said flexible printed circuit board and said extension portion extending away from the rear surface of said flexible printed circuit board;

a connecting member for being electrically and mechanically connected to said connecting object, said connecting member comprising an insulator block and a contact supported in said insulator block, said contact having a terminal end connected to said connecting object and a contact portion, said connecting member having a receiving hole for loosely receiving said end portion of said insulating resilient piece and said sheet end of said flexible printed circuit board together, said contact portion exposed in said receiving hole; and an actuating member for pressing said extension portion of said insulating resilient piece towards the rear surface of said flexible printed circuit board when said end portion of said insulating resilient piece and said sheet end of said flexible printed circuit board are received together in said receiving hole, whereby said conductor pattern of said flexible printed circuit board is pressed onto and is brought into contact with said contact portion.

2. An electrical connector as claimed in claim 1, which further comprises insulator support for supporting said flexible printed circuit board and said actuating member, said insulator support having a fitting portion for fitting to said insulator block.

3. An electrical connector as claimed in claim 2, wherein said actuating member is an operating rod rotatably mounted in said insulator support, said operating rod having an operating cam portion so that said operating cam pressing said extension portion of said insulating resilient piece towards said rear surface of said flexible printed circuit board when said operating rod is at a first rotating angle position.

4. An electrical connector as claimed in claim 2, wherein said actuating member is an operating plate removably fitted into said insulator support, said operating plate pressing said extension portion of said insulating resilient piece towards said rear surface of said flexible printed circuit board when said operating plate is fitted into said insulator support.

5. An electrical connector as claimed in claim 4, wherein said operating plate is a circuit board which is electrically connected to said flexible printed circuit board at the opposite end thereof.

6. A multi-row connector for establishing electric connection to a paired connector comprising contact rows of a plurality of contacts in each contact row, said multi-row connector comprising: a first insulator block having a sheet receiving hole; a pair of flexible contact sheets having individual front surfaces and individual sheet ends with rows of parallel conductor patterns, not less in number than said contacts in each contact row, arranged on each of said front surfaces to reach said sheet ends and with said flexible contact sheets received in said sheet receiving hole in a back to back opposing relation; a second insulator block having a sheet receiving groove for receiving said flexible contact sheets with said sheet ends protruded through said sheet receiving groove; and an actuating member for actuating said flexible contact sheets to bring said parallel conductor patterns at said sheet ends near to said contacts after said second insulator block is brought into contact with said paired connector to place said conductor patterns near at said sheet ends to said contacts; wherein:

said multi-row connector comprises a pair of insulating resilient pieces having individual piece ends fixed to said sheet ends, respectively, and extended backwardly of said flexible contact sheets to have individual free ends spaced apart by a predetermined distance and to be placed in said sheet receiving groove;

said actuating member having a greater diameter greater than said predetermined distance so as to be freely inserted between said free ends and to push said free ends apart when said actuating member is inserted between said free ends to be subsequently positioned between said free ends with said greater diameter directed substantially perpendicularly to said predetermined distance.

7. A multi-row connector as claimed in claim 6, wherein said first and said second insulator blocks have side surfaces parallel to a direction of said opposing relation of said flexible contact sheets, said first and said second insulator blocks having a member receiving hole greater than said greater diameter for receiving said actuating member in said side surfaces when put together, said actuating member serving as an operating cam for insertion through said member receiving hole.

8. A multi-row connector as claimed in claim 6, further comprising a cover member for covering and receiving said first insulator block on its top, said cover member having an insertion portion protruding in said member receiving hole and having a thickness greater than said predetermined distance to serve as said actuating member when inserted between said free ends.

9. A multi-row connector as claimed in claim 6, said multi-row connector being for further connection to a daughter board having a pair of board surfaces and a shim end of a predetermined thickness between said board surfaces with a plurality of conductive patterns formed on said board surfaces in correspondence to said conductor patterns, wherein said first insulator block has a pair of sheet receiving holes collectively as said sheet receiving hole for individually receiving said flexible contact sheets, said predetermined thickness being not smaller than said predetermined distance, said shim end serving as said actuating member tucking said flexible contact sheets with said conductor patterns brought into contact with said conductive patterns when said daughter board is pushed into said predetermined distance.

10. A multi-row connector as claimed in claim 9, wherein said shim end has flanges which abut said first insulator blocks when said shim end is put between said free ends.

11. A multi-row connector as claimed in claim 10, wherein said second insulator block has a pinhead receiving hole, said daughter board having a pinbody receiving hole for alignment with said pin-head receiving hole, an insertion pin being inserted in said pinhead and said pinbody receiving holes after said shim end is put in said sheet receiving groove to bring said pinhead and said pinbody receiving holes in alignment.

* * * * *